US005480521A

United States Patent [19]

Snyder, Jr. et al.

[11] Patent Number: 5,480,521

[45] Date of Patent: Jan. 2, 1996

[54] TENDON FOUNDATION GUIDE CONE ASSEMBLY AND ANODE

[75] Inventors: Dale R. Snyder, Jr.; James D. Smith; James W. Stevens; Robert M. Kipp, all of Houston, Tex.

[73] Assignee: Shell Oil Company, Houston, Tex.

[21] Appl. No.: 357,830

[22] Filed: Dec. 16, 1994

[51] Int. Cl.[6] ..... C23F 13/00; E02D 31/06

[52] U.S. Cl. ..... 204/148; 166/338; 166/340; 166/342; 166/355; 204/197; 405/195.1; 405/211; 405/224

[58] Field of Search ..... 204/147, 148, 204/196, 197; 166/338, 340–343, 355; 405/203, 211, 216, 224

[56] References Cited

U.S. PATENT DOCUMENTS

| | | | |
|---|---|---|---|
| 4,614,461 | 9/1986 | Taniguchi et al. | 204/197 |
| 4,629,366 | 12/1986 | Rutherford et al. | 204/197 |
| 4,705,331 | 11/1987 | Britton | 204/197 |
| 4,797,036 | 1/1989 | Collins et al. | 405/195.1 |
| 4,907,914 | 3/1990 | Gunderson et al. | 166/340 |
| 4,943,188 | 7/1990 | Peppel | 405/224 |
| 4,968,183 | 11/1990 | Hannus et al. | 405/195.1 |
| 5,190,107 | 3/1993 | Langner et al. | 166/355 |
| 5,193,939 | 3/1993 | Nagatani et al. | 405/211 |

*Primary Examiner*—T. Tung
*Attorney, Agent, or Firm*—Mark A. Smith

[57] ABSTRACT

A method of providing a cathodic protection to an installed pile is disclosed in which a plurality of anodes are provided on a tendon foundation guide assembly which is attached to a lowering unit and lowered to the pile. The tendon foundation guide assembly is attached to the installed pile and at least one of the anodes is electrically connected to the pile. The tendon foundation guide assembly is then separated from the lowering unit. In another aspect of the invention, a tendon foundation guide assembly is disclosed for deployment upon the top of an installed pile for cathodically protecting the pile and a tendon receptacle inside the pile.

18 Claims, 8 Drawing Sheets

FIG. 4E
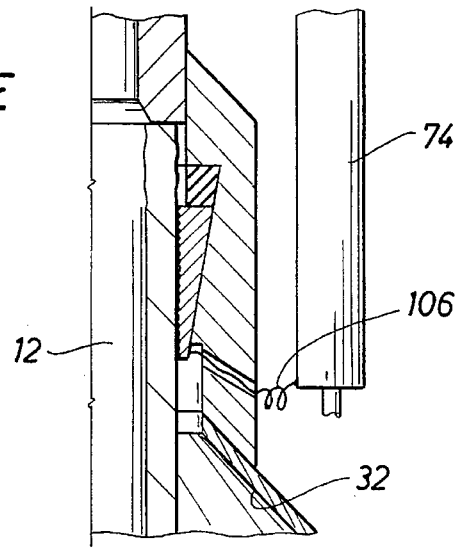
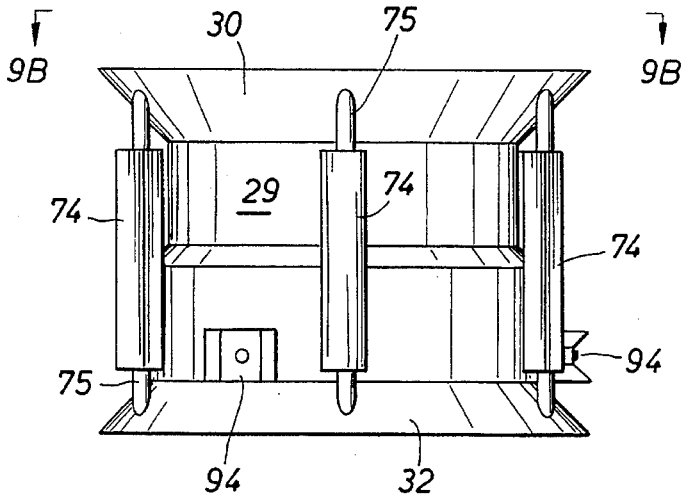
FIG. 9A
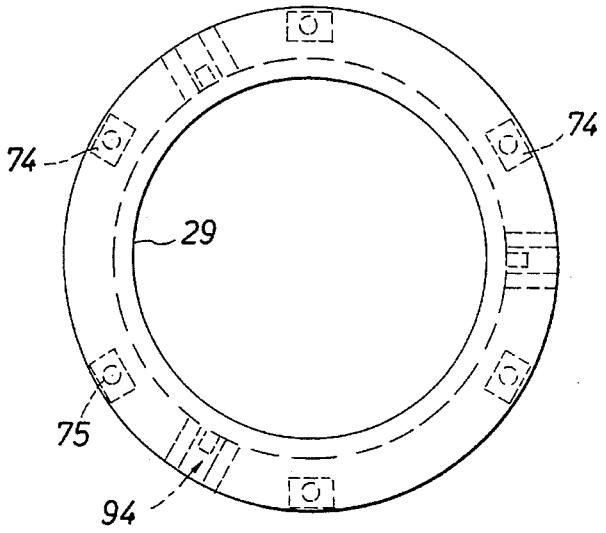
FIG. 9B

TENDON FOUNDATION GUIDE CONE ASSEMBLY AND ANODE

BACKGROUND OF THE INVENTION

The present invention relates to deepwater platform foundations. More particularly, it relates to providing cathodic protection to a tension leg platform foundation anchored to the ocean floor through a plurality of piles.

As used herein, a "tension leg platform" or TLP refers to any buoyant structure tethered to the ocean floor through substantially vertical tendons tensioned to draw the buoyant structure below its normal floating draft. Various embodiments include a full scale TLP having full drilling facilities, a tension leg well platform ("TLWP") having only a scaled down "completion" rig, a tension leg well jacket ("TLWJ") designed to accept well operations from an auxiliary vessel, or any other tendon deploying variation.

Tendons connect the buoyant hull to a foundation system at the ocean floor and are tensioned to draw the buoyant hull below its normal floating draft. The tendons transmit this static load to the foundation system. Further, the tendons must transmit this static load while subject to additional loads which have significant cyclical components driven by environmental forces of wind, wave and current on the hull and tendons. The combined load is transmitted to the ocean floor through the foundation system.

The bottoms of the tendons are secured to a foundation system at tendon receiving load connections or tendon receptacles. In the traditional practice for a steel foundation, the foundation system is built around a foundation template and pinned to the ocean floor with a plurality of piles, each secured to the template through a pile sleeve and connected thereto, e.g., by swaging operations deforming the pile into annular grooves on the surrounding pile sleeve. The tendon receptacles are provided elsewhere on the template. The template is a therefore framework which serves to permanently interconnect the tendon receptacles and the pile sleeves.

The template is cathodically protected by a plurality of sacrificial anodes that are conveniently placed before deployment. Conventional cathodic protection electrically connects the structural elements to be protected with sacrificial anodes which bear the corrosive effects of the saltwater environment. So long as sufficient cathodic current passes between the anode and the structural elements, only the anode will corrode and the structural elements will remain substantially unscathed.

However, the tendon-to-receptacle, to-template (and over)-to pile sleeve, to-pile, to-ocean floor load path of the conventional template based foundation system is an inefficient load transfer scheme, exacerbates the fatigue response, and creates handling difficulties. An improved TLP foundation system has been recently proposed which provides a more direct load transfer path of tendon-to-tendon receptacle-to-pile-to-ocean floor. This system is more fully disclosed in pending patent application Ser. No. 08/236,294, for a Direct Tendon to Pile Connection, filed by E. Doyle et al on May 2, 1994, the complete disclosure of which is hereby incorporated by reference into the present application.

However, deployment of that improved TLP foundation has potential drawbacks in embodiments eliminating the template and placing the tendon receptacles within the piles. Since no template is available for placing anodes. It is then very important to provide the piles with cathodic protection, including, if possible, the load bearing elements presented in the tendon receptacle which restrain the tendon after installation. The bottom of the tendon may be provided with its own anodes, but this will not ordinarily efficiently pass cathodic current across load the bearing interface to protect the load lugs in the tendon receptacle. This is especially a problem when the direct tendon to pile connection involves driven piles because anodes are typically made from soft materials such as aluminum, zinc, and magnesium alloys and those placed before pile installation will not stand up to pile driving operations which would tend to loosen or knock off the anodes.

Absent appropriate cathodic protection, substantially greater quantities of structural steel must be used to accommodate the corrosive effects of seawater over the life of the platform.

Therefore there is a need to provide cathodic protection to the piles of such a foundation system after pile installation.

SUMMARY OF THE INVENTION

An advantage of the illustrative apparatus and method is that they provide a means for providing cathodic protection to a previously installed pile.

Another advantage of the illustrative apparatus and method is that they facilitate use of driven pile installation procedures for an improved TLP foundation using a tendon-to-tendon receptacle-to-pile-to ocean floor load path.

Toward the fulfillment of these and as well as other advantages, a method of providing a cathodic protection to an installed pile is disclosed in which a plurality of anodes are provided on a tendon foundation guide assembly which is attached to a lowering unit and lowered to the pile. The tendon foundation guide assembly is attached to the installed pile and at least one of the anodes is electrically connected to the pile. The tendon foundation guide assembly is then released from the lowering unit.

In another aspect of the invention, a tendon foundation guide assembly is disclosed for deployment upon the top of an installed pile for cathodically protecting the pile and a tendon receptacle inside the pile. The tendon foundation guide assembly has a downwardly disposed bottom cone guide, a cylindrical base attached to the top of the bottom cone guide, transfer mounts provided by the tendon foundation guide assembly suitable to releasably secure the tendon foundation guide to a lowering device; and an upwardly disposed top cone guide connected to the cylindrical base and presenting a guide surface suitable to guide the lower end of the tendon into reception within the tendon receptacle within the installed pile. The cylindrical base has a load shoulder projecting radially inward from the cylindrical base to accept and seat upon the top of the installed pile, an anode structure comprising a plurality of electrically interconnected anodes, and a connection device provided by the cylindrical base suitable to 1) secure the tendon foundation guide assembly to the pile and 2) provide a secure electrical connection between the anode structure and the pile.

A SUMMARY OF THE DRAWINGS

FIGS. 4A–4E are partially cross sectioned views of a deployment of a tendon foundation guide cone using an illustrative method carrying the assembly on a tendon;

FIG. 9A is a side elevational view of a tendon foundation guide cone assembly in another embodiment of the present invention; and FIG. 9B is a top elevational view of the tendon foundation guide cone assembly of FIG. 9A.

A DETAILED DESCRIPTION OF ILLUSTRATIVE EMBODIMENTS

Figure 1:
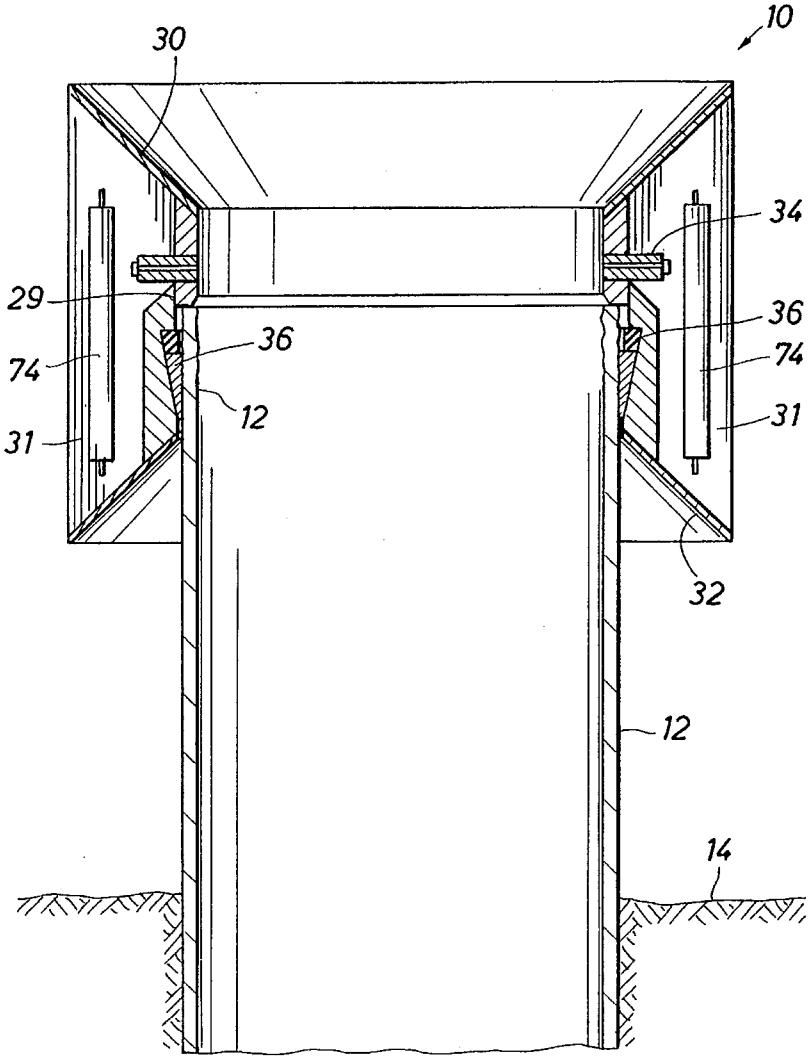
FIG. 1 is a cross sectional view of a tendon foundation guide cone and anode assembly constructed in accordance with the present invention.

Tendon foundation guide cone and anode assembly or guide cone assembly 10 in FIG. 1 is one illustrative embodiment of the present invention. Guide cone assembly 10 is secured to the top end of a pile 12, which in turn is secured to ocean floor 14. This embodiment provides an upwardly and outwardly extending guide surface or tendon guide cone 30, a downwardly and outwardly extending guide surface or pile guide cone 32, a cylindrical base 29 between the tendon guide cone and the pile guide cone, a connection device 36 attaching the guide cone assembly to the top of the pile, and transfer or transport mounts 34. A plurality of vertical stiffeners or vanes 31 extend between guide cones 30 and 32 and down cylindrical base 29 therebetween. A plurality of anodes 74 are provided on vanes 31 or on cylindrical base 29.

Guide cone assemblies 10 are useful in providing cathodic protection to critical elements anchoring tension leg platforms ("TLPs") 16 in place for deepwater offshore oil and gas operations. See FIG. 2. Buoyant superstructure 18 of TLP 16 is tethered to ocean floor 14 through a plurality of tendons 20. The tendons are in turn secured with the tops of piles 12 which have been installed into ocean floor 14. Tendons 20 are tensioned so as to draw superstructure 18 below its free floating draft. This limits platform response to wave and other environmental forces and provides increased stability from which to conduct oil and gas operations, e.g., the drilling operations illustrated with derrick 22 and drill string 24.

Figure 3:
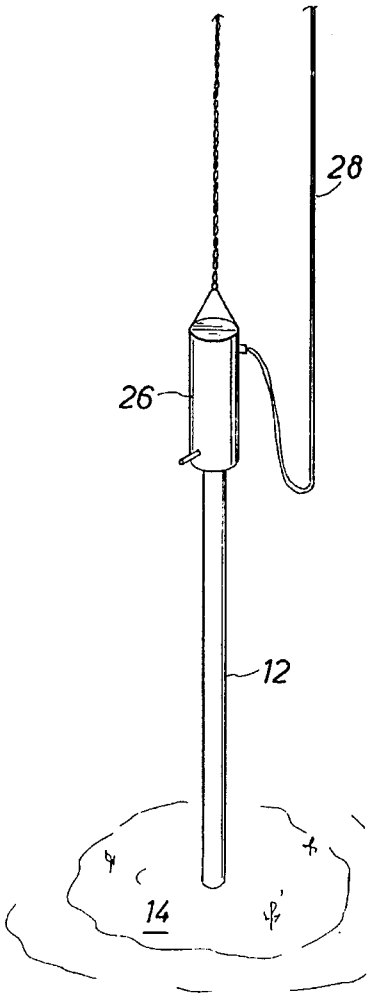
FIG. 3 is a perspective view of pile being installed by driving operations with an underwater hammer.

Installation of such a TLP begins with installation of the piles 12. See FIG. 3. One of the preferred installation methods is to drive the pile with an underwater pile driver or hammer 26 driven hydraulically through hose 28. The underwater hammer strikes the top of the pile with impact blows which drive the pile incrementally toward a depth at which the skin friction on the outside of pile 12 in ocean floor 14 will securely resist the tremendous buoyant loads of TLP superstructure 18. See FIG. 2.

Many, many high impact hammer blows are necessary to achieve this depth after the initial self penetration in the soft subsea sediments. In recent example, the drive depth was calculated to be between 150 to 200 feet beyond the initial self penetration for a given deepwater TLP deployment. Such activity must be anticipated to cause local deformation at the top of the pile. See FIG. 1. Tendon foundation guide cone and anode assembly 10 connects to the potentially irregular top of pile 12 to cathodically protect the pile and also conveniently presents tendon guide cone 30. This guide cone is very useful to TLP installation because it helps inserting the tendon into the top of the pile in order to pass to a tendon receptacle in which it is secured. Tendon guide cone 30 substantially increases the effective target area for correct tendon reception for tendons controlled from a surface vessel which is 1) subject to varying degrees of wave action and 2) a considerable distance, e.g., perhaps a half mile or more above ocean floor at which this connection must be made.

FIGS. 4A–4D illustrate one method for providing tendon guide cone and anode assembly 10 to installed pile 12. Here, guide cone assembly 10 is mounted on a lowering unit 21 in the form of the base of tendon 20 at a tendon bottom termination assembly 38. Guide cone assembly 10 is attached to the tendon bottom termination assembly through a plurality of shear bolts 40, each extending from a sliding block 42, and is lowered toward pile 12. See FIG. 4A. The final approach may be guided electronically though cameras, transponders, or other surveillance equipment provided on these elements or a remotely operated vehicle ("ROV") (not shown) positioned to observe operations.

Figure 2:
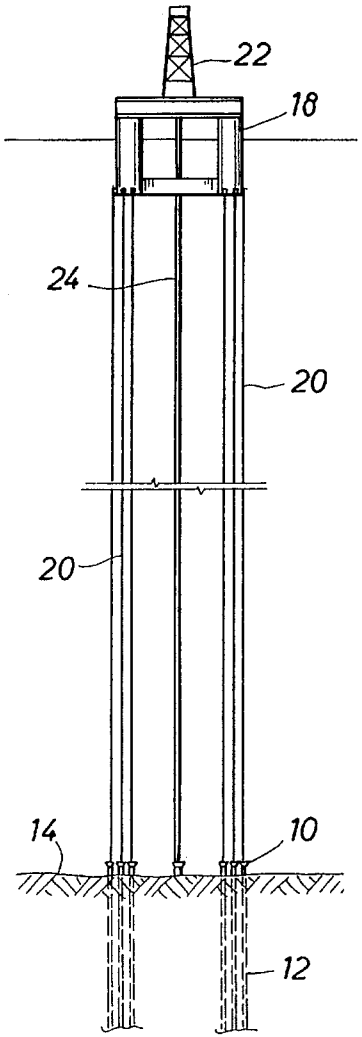
FIG. 2 is a side elevational view of a TLP illustrating an environment for the ultimate deployment of the present invention.

Pile guide or bottom cone 32 guides the final approach as cone assembly 10 slips over the end of pile 12, see FIG. 2, and slips into attachment position as annular load shoulders 44 come to rest on the top of pile 12. See FIG. 4B. In this embodiment connection device 36 is provided by a plurality of self actuating vertically disposed slips 46. In this embodiment a spring in the form of elastomeric block 48 biases the slips downward and they are thereby driven inward to bite into the exterior surface of pile 12 to secure engagement of cone assembly 10 thereon. Alternatively, other spring action on self-weight may self actuate the slips or the slips may be manually actuated, e.g., by a ROV turning drive screws.

This same bite provides an efficient electrical connection through which cathodic current runs between pile 12 and anode 74 through lead wire 106 and slips 46. See FIG. 4E.

Figure 4B:
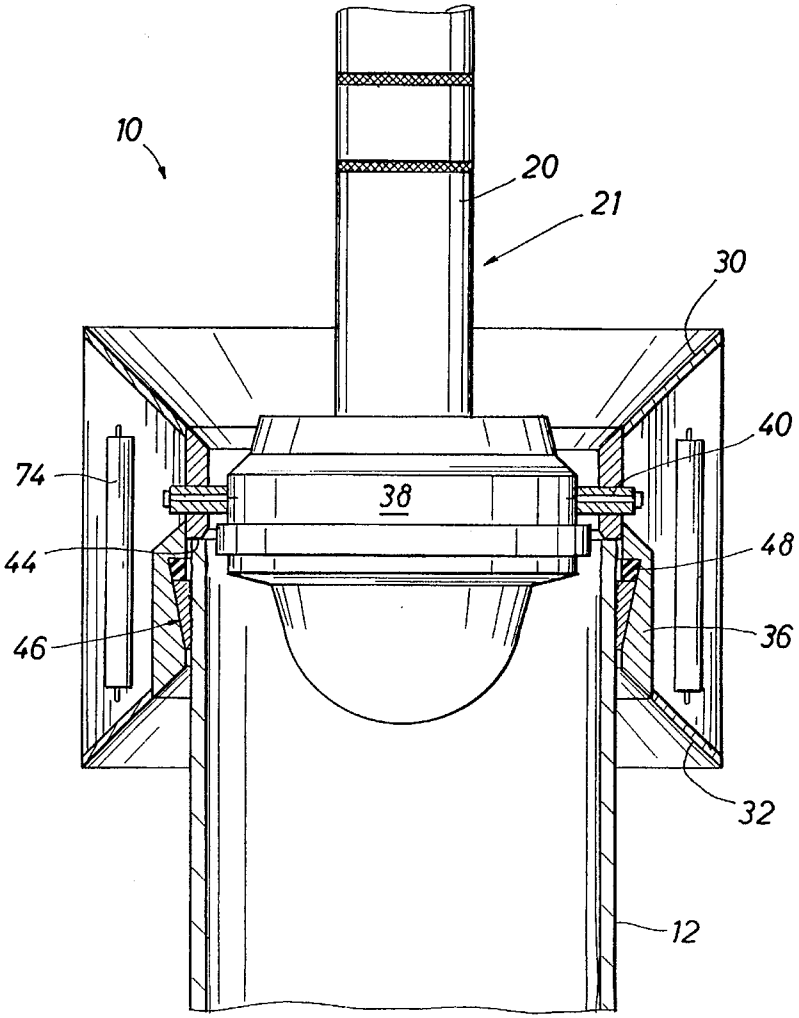
Figure 4A:
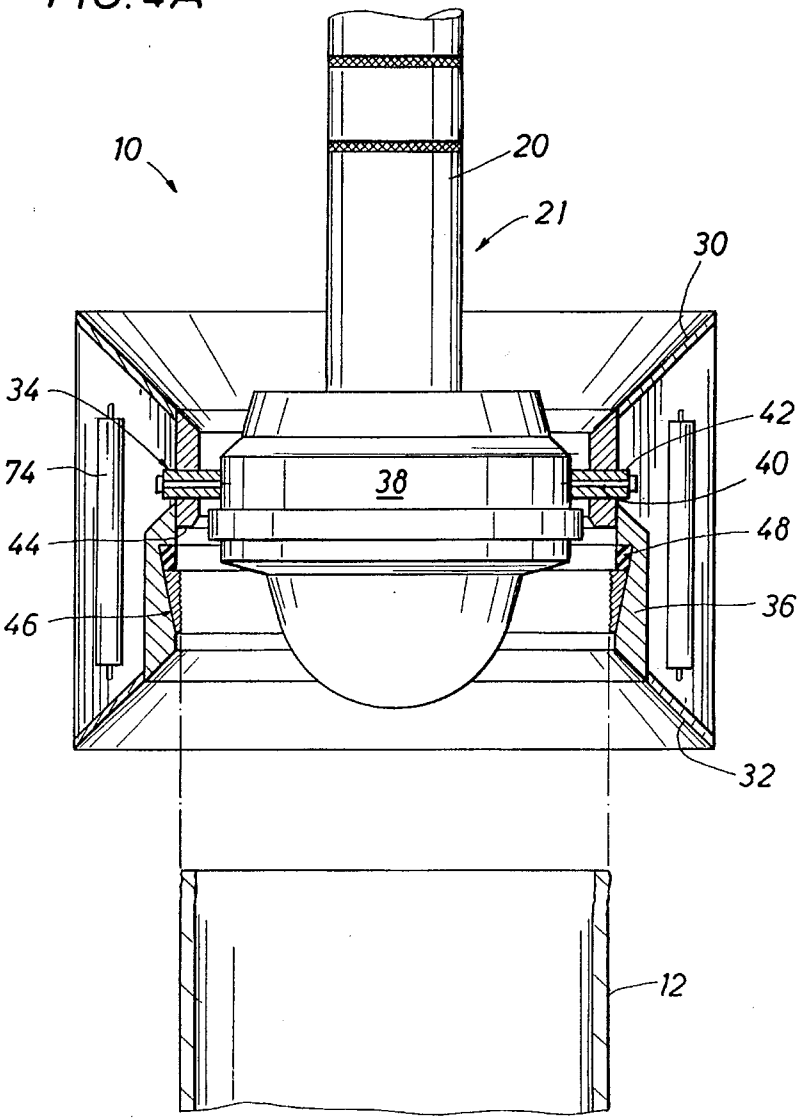
Figure 4D:
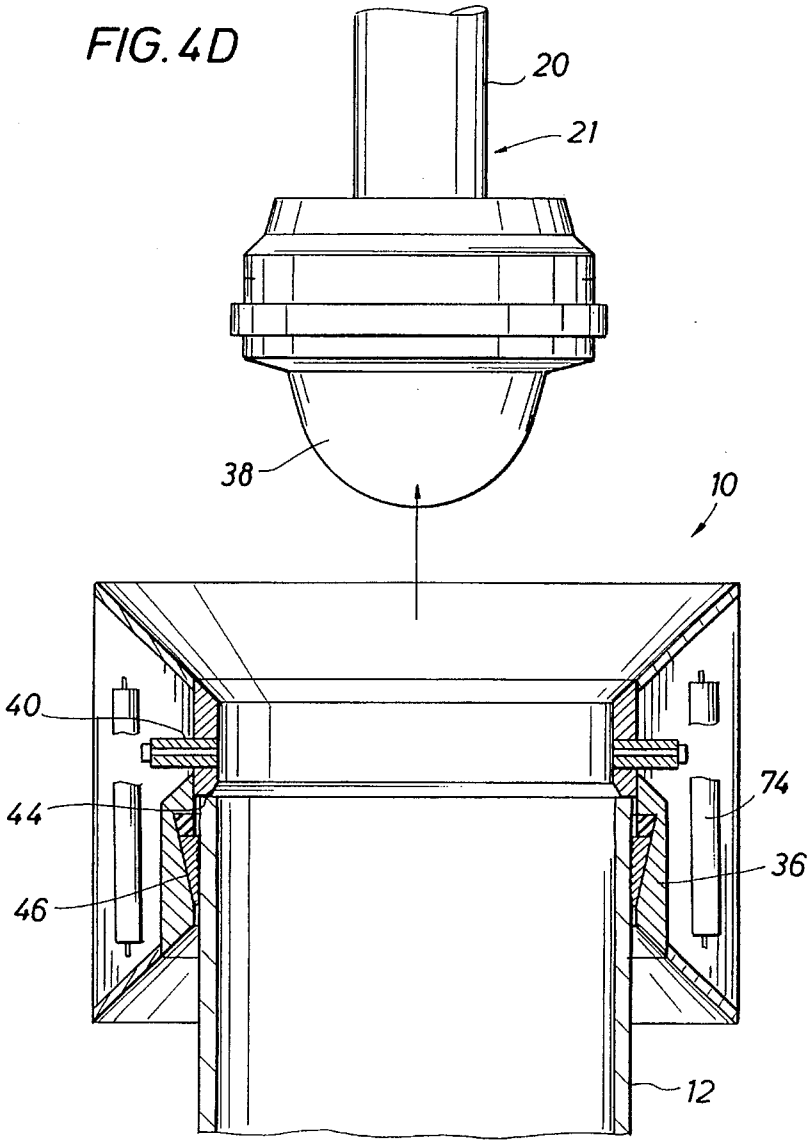
Figure 4C:
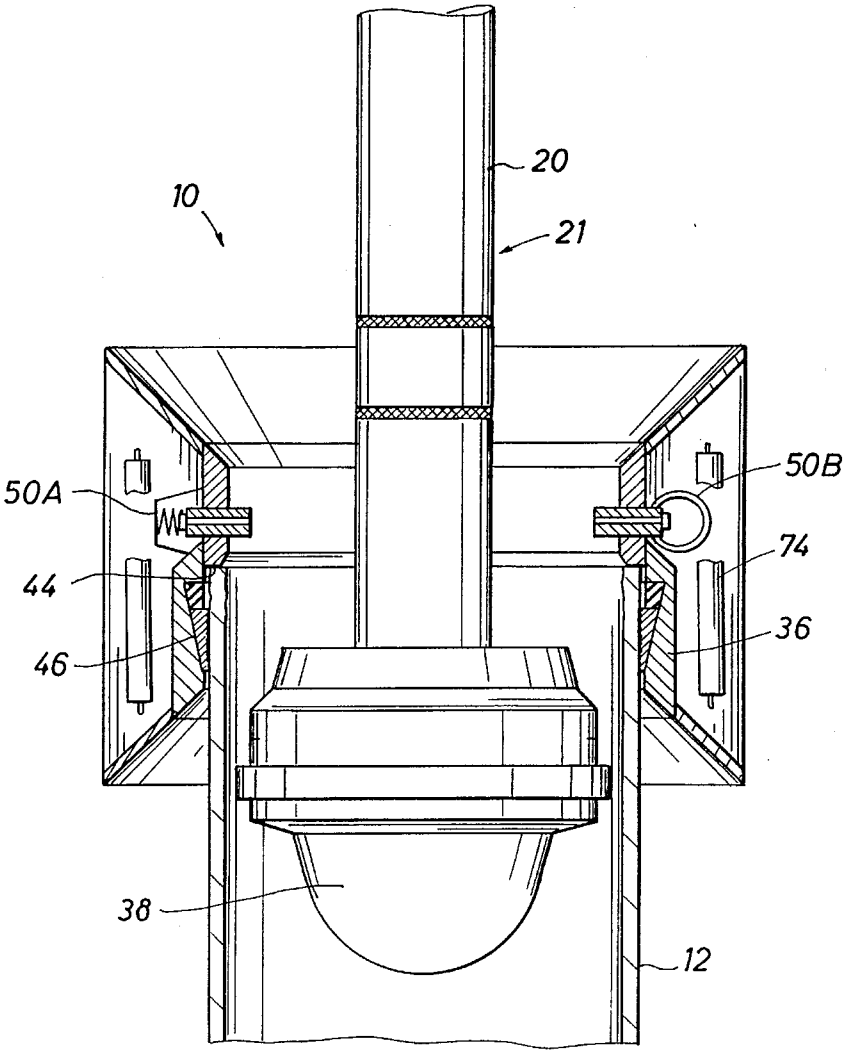

Turning to FIG. 4C, further lowering of the tendon shears off shear bolts 40. Sliding blocks 42 may be spring biased to then withdraw or may be withdrawn by ROV assist, schematically represented in FIG. 4C (only) by spring 50A and handle 50B, respectively. These are withdrawn to the position illustrated in FIG. 4D and tendon bottom termination assembly 38 may be installed or, if necessary, withdrawn from pile 12. If withdrawn, tendon guide cone 30 remains on pile 12 to guide re-entry of the tendon.

Figure 5A:
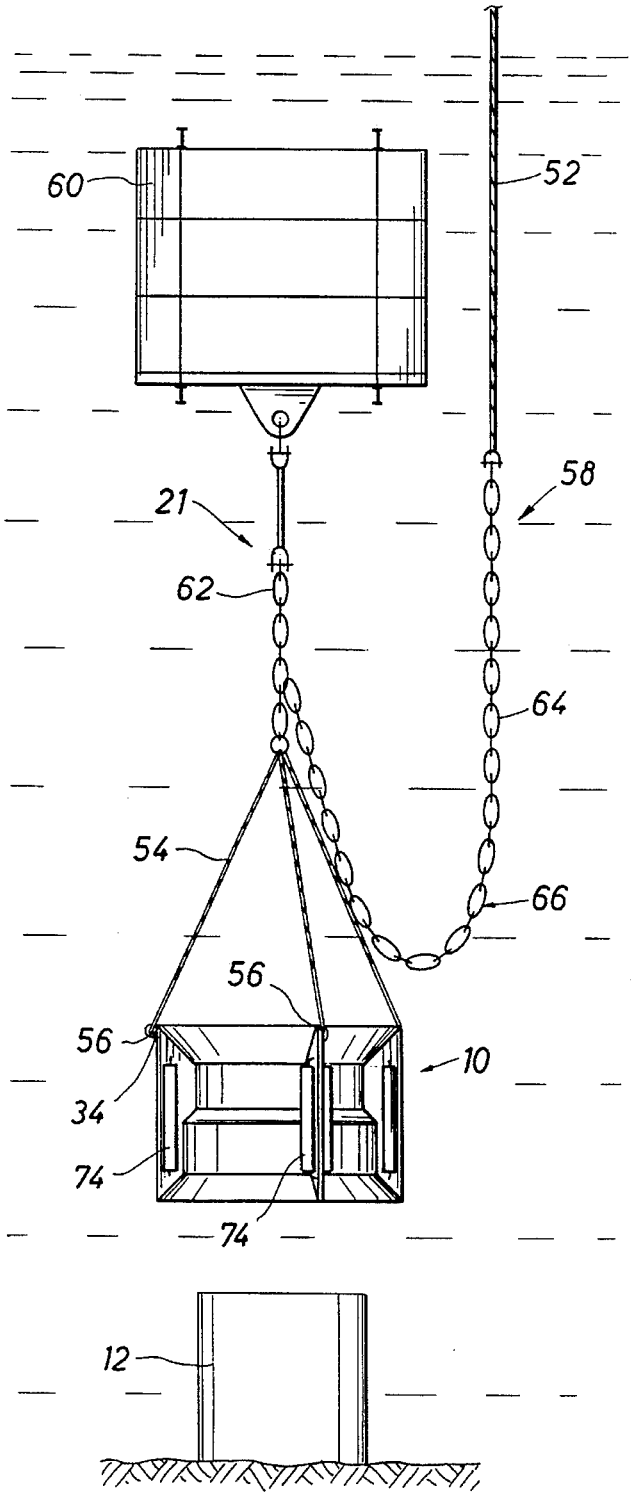
FIGS. 5A–5B are side elevational views of a deployment of a tendon foundation guide cone and anode assembly using an illustrative method carrying the assembly on a cable system.
Figure 5B:
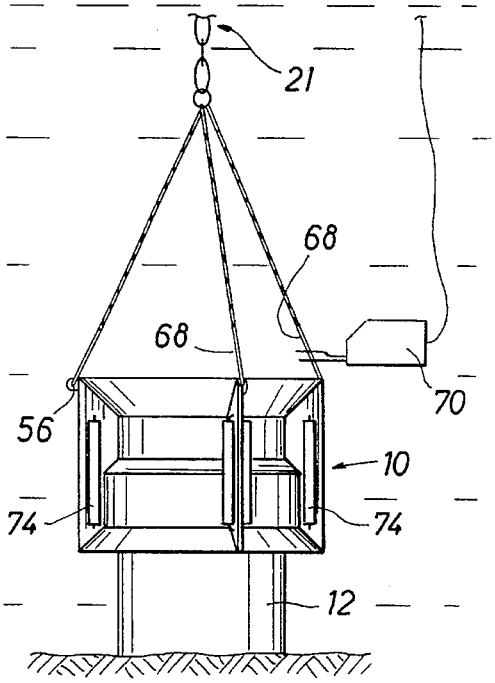

FIGS. 5A and 5B illustrate another method for providing tendon foundation cone and anode assembly 10 to installed pile 12. Here, guide cone assembly 10 is lowered on the bottom of a crane lift line 52 though a multi-point hitch 54 connected to cone assembly 10 at pad eyes 56 for transport mount 34 connecting guide cone assembly 10 to lowering unit 21. It may be desired to use a heave-compensated buoy system 58 including a subsurface buoy 60, lift line 62, and compensating lift line 64 having a catenary loop 66 below the subsurface buoy. Such a system can be useful to establish a natural frequency for the overall system which is materially different than the average wave frequency acting on the surface vessel. This will reduce motions and increase control when positioning guide cone assembly 10. A fuller discussion of this is provided by U.S. Pat. No. 5,190,107 for a Heave Compensated Support System for Positioning Subsea Work Packages which was filed by Langner et al and issued Mar. 2, 1993. The disclosure therein is hereby incorporated by reference in its entirety and made a part hereof. Alternatively, hitch 54 may be connected directly to the cable of a barge crane. In addition, a buoy 60 may be used, with or without the heave compensating lift line, to render guide cone assembly 10 near neutrally buoyant for ROV deployment.

The final approach is again guided as discussed with the preceding embodiment, and guide cone assembly 10 slips over and seats upon the top of pile 12 and a connection device may be engaged securing the guide cone assembly on the top of the pile. See FIG. 5B. If a heave compensated buoy system has been used, it may now be desired to take on ballast or add a weight to the subsea buoy 60. Three point hitch 54 is then removed from guide cone assembly 10, e.g., by cutting cable loops 68 which pass through pad eyes 56 with an ROV 70. The three point hitch is then retrieved.

Figure 6:
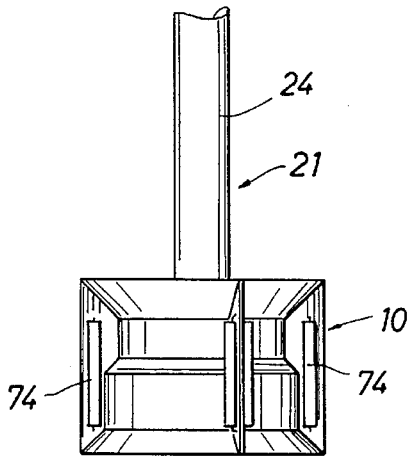
FIG. 6 is a side elevational view of a deployment of a tendon foundation guide cone and ,anode assembly using an illustrative method carrying the assembly on a drill string.

FIG. 6 illustrates another embodiment of the present invention in which tendon foundation guide cone and anode assembly 10 is carried on the end of lowering unit 21 in the form of a drill string 24 extending from a semisubmersible drilling vessel (not shown). The transfer mounts may conveniently provide a shear bolt arrangement similar to that discussed above with the illustrative embodiment of FIGS. 4A–4D having a tendon carried guide cone assembly. An advantage of this illustrated embodiment having a drill string carried guide cone assembly is that it is better adapted to batch operations should it be desired to provide guide cone assemblies to all of the piles before installing the tendons. This is because the semisubmersible drilling facilities are very efficient at adding and removing drill pipe to run and pull drill string 24. Tendons are also typically made up from constituent pipe lengths that are then connected together, but these have conventionally been designed for long term load service without the same attention in favor of easy, repeated assembly and disassembly.

Figure 7B:
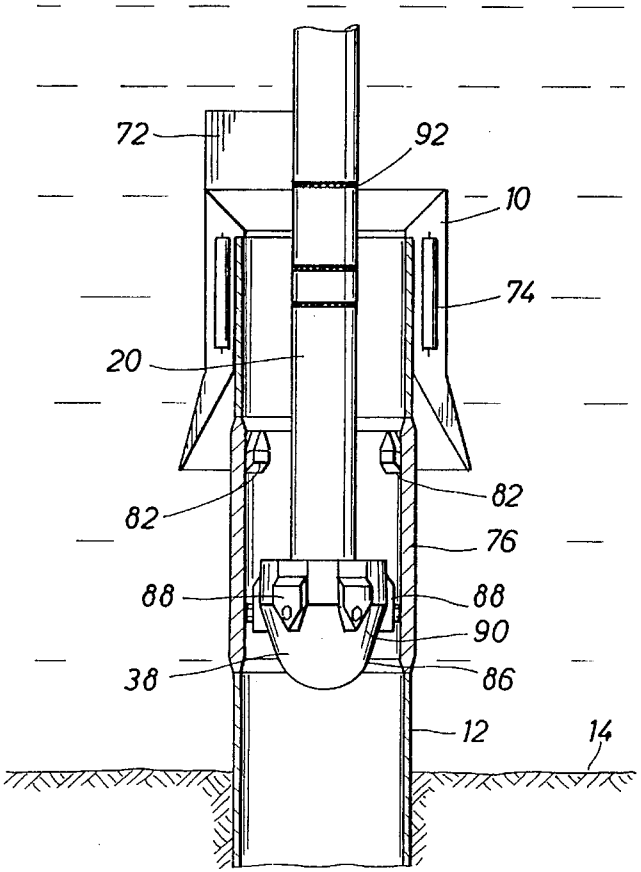
FIGS. 7A–7D are partially cross sectioned views of tendon installation using an illustrative embodiment of a tendon foundation guide cone and anode assembly in accordance with the present invention.
Figure 7A:
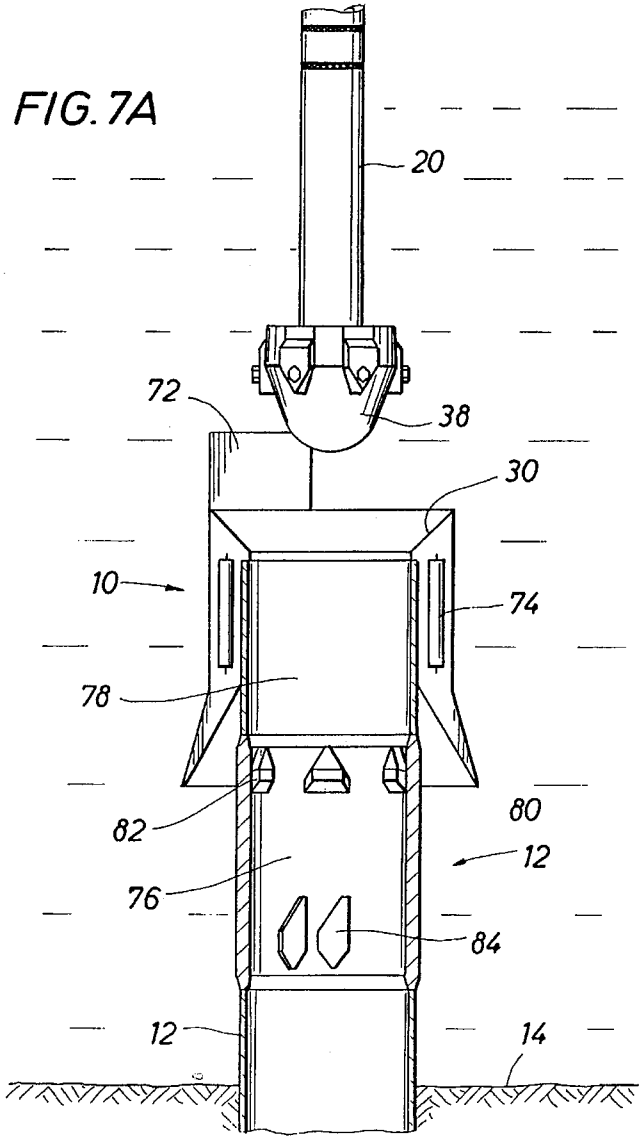
Figure 7D:
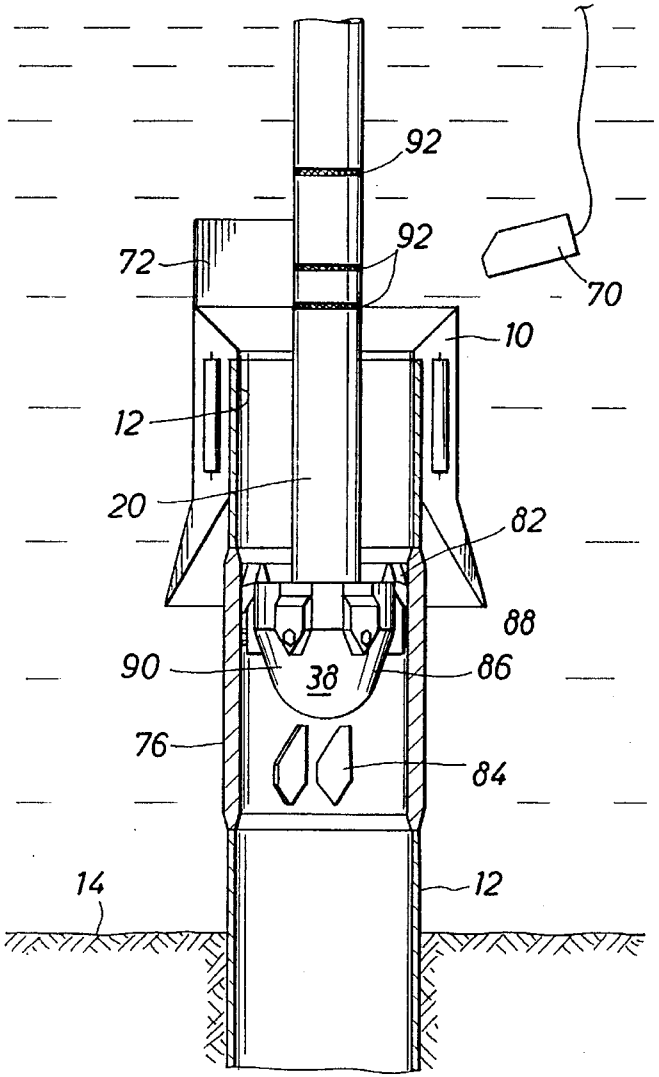
Figure 7C:
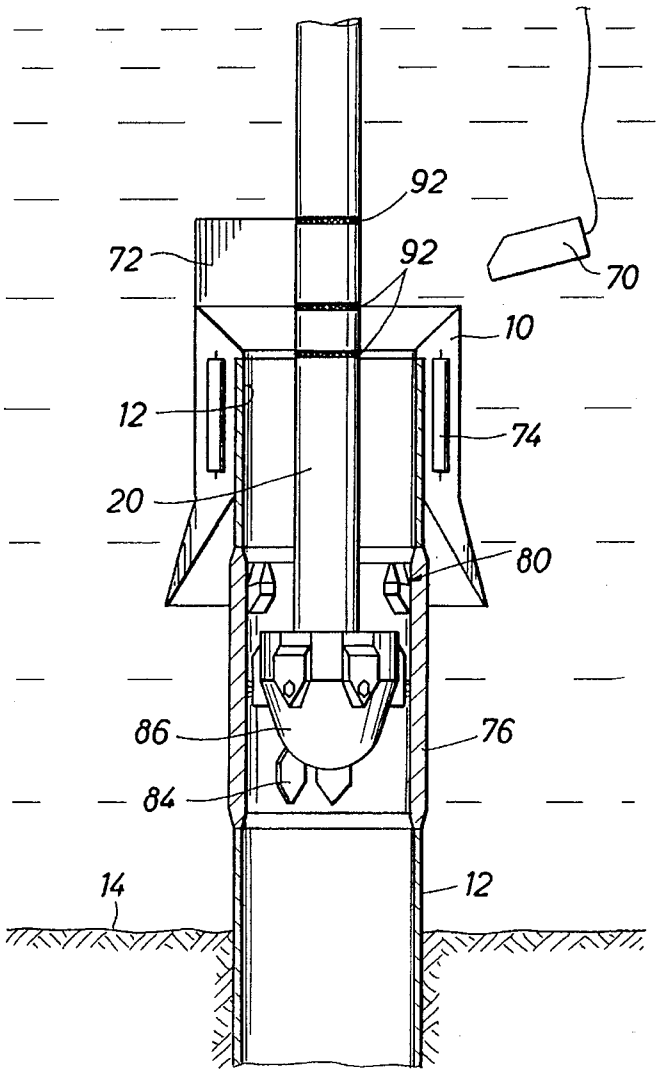

FIGS. 7A–7D illustrate one form of tendon installation. Tendon 20 in FIG. 7A is approaching tendon foundation guide assembly 10 which has been installed on the top of pile 12. The tendon may be subject to long period pendulum motions in its approach and it may be desired to provide a catch plate 72 extending above the top of tendon guide cone 30. If the bottom of the tendon is swinging in long period motion, it is preferable to swing the tendon bottom termination assembly 38 into catch plate 72 to stop this motion, then proceed down tendon guide cone 38.

Another feature of the illustrated embodiment is the addition of a plurality of anodes 74. These anodes provide important corrosion protection to pile 12, possibly including to a lesser extent, the load bearing elements inside that restrain the tendon after installation. (It may also be desired to protect interior pile surface independently, e.g., a flame sprayed aluminum coating.) This ability to later add cathodic protection to the pile is very useful because anodes are typically made from soft materials such as aluminum, zinc and magnesium alloys and pile driving operations would be expected to loosen or knock off anodes if installed before pile installation. This is also a problem because of the volume of anode material required. One application recently calculated suggests that 2000 lbs. or more may be required to protect a single pile over the life of the project.

This cross sectional view also illustrates a tendon receptacle 76 beneath drive head 78 of pile 12 and illustrates one system for connecting tendon bottom termination assembly 38 to pile 12. The tendon receptacle provides a load ring 80 having a plurality of lugs 82 as well as a plurality of guides 84. In this embodiment, the tendon bottom termination assembly is a rotating lug anchor connector 86 having a freely rotating load ring 90 from which lugs 88 project.

Upon further lowering of rotating lug anchor connector 86 into tendon receptacle 76 the load ring bearing lugs 88 is rotated by camming action upon guide surfaces to achieve an alignment of lugs 88 with lugs 82 which allows anchor connector 86 to pass load ring 80. See FIG. 7B. Further insertion brings lugs 88 into contact with camming surfaces on a lower set of guides 82 which again rotate load ring 90 about the base of tendon 20, see FIG. 7C such that pulling up on the tendon will cause lugs 88 to align with lugs 82 and engage in load bearing relation. See FIG. 7D. If necessary, the tendon may be released by again vertically stroking rotating lug anchor connector 86 through lower guides 84 which will then align lugs 88 on rotating load ring 90 with the spaces between lugs 82 to permit withdrawal. Visual confirmation with ROV 70 of markings 92 on tendon 20 may be useful to monitor progress of the latching sequence. The equipment and latching sequence summarized in above are discussed in greater detail in U.S. Pat. No. 4,943,188 issued to Peppel on Jul. 24, 1990 for a Rotating Lug Anchor Connector. That disclosure is hereby incorporated by reference in its entirety and made a part hereof.

Figure 8A:
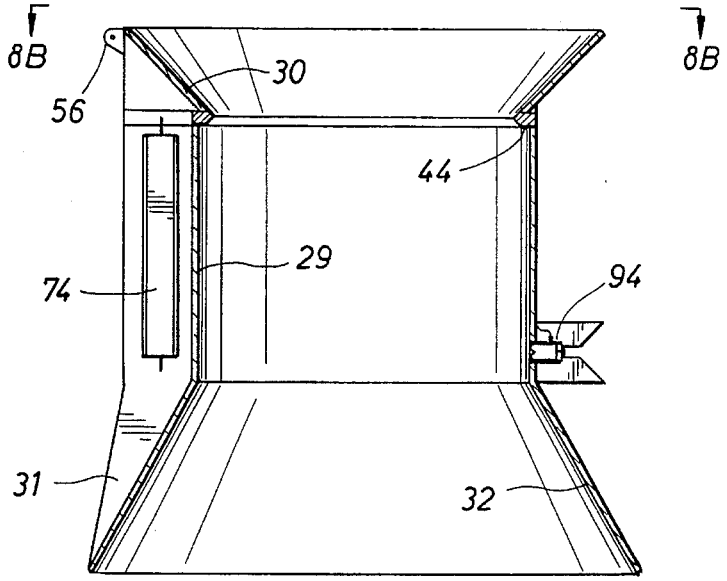
FIG. 8A is a cross sectional view of an illustrative embodiment of a tendon foundation guide cone and anode assembly in accordance with the present invention taken along lines 8A—8A in FIG. 8B.
Figure 8B:
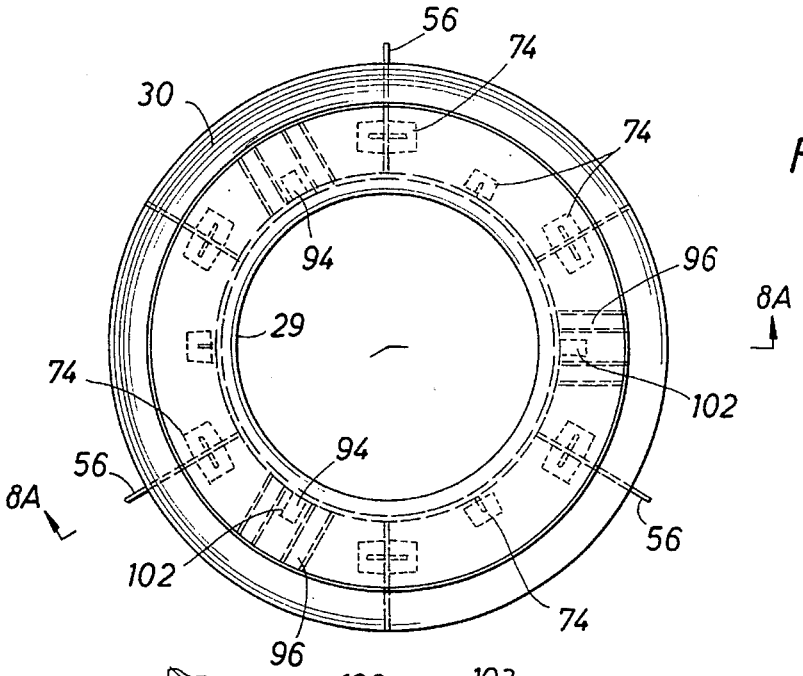
FIG. 8B is a top elevational view of the tendon foundation guide assembly of FIG. 8A taken from the vantage point of line 8B—8B in FIG. 8A.

FIGS. 8A and 8B illustrate another embodiment of a tendon foundation guide cone assembly in accordance with the present invention. FIG. 8A is a cross sectional view taken longitudally through tendon foundation guide cone assembly 10 with tendon guide cone 30 and pile guide cone 32 joint to cylindrical base 29 which is sized to fit over an installed pile. Annular load shoulder 44 is provided at the juncture of the tendon guide cone and the cylindrical base. Note that the area and angle of pile guide cone 32 exceeds that of tendon guide cone 30. This is because the intended tendon bottom termination assembly (not shown) is provided with a rounded leading edge which will cooperate with a shallower angle. However, the leading edge of the pile is its outer diameter. This is larger and more "squared" on profile and requires a relatively larger and steeper guide cone to facilitate sliding of the guide cone assembly onto the pile top and prevent hanging up.

The length of cylindrical base 29 and its relative snug fit about the top of pile 12 may serve to adequately connect guide cone assembly 10 to pile 12 under the influence of gravity. Nevertheless, slips as discussed above or, as illustrated, a plurality of ROV operable set screws 94 may be deployed to more securely and rigidly mount guide cone assembly 10 to a pile.

Tendon foundation guide cone assembly 10 is provided with a plurality of anodes 74 connected to vertical stiffeners or vanes 31 and to cylindrical base 29. See also FIG. 8B. Further, in this embodiment electrical connection with the anodes necessary to cathodically protect the pile is also secured with set screws 94. It may further be convenient to provide guide plates 96 about set screws 94 to assist ROV makeup.

Figure 8C:
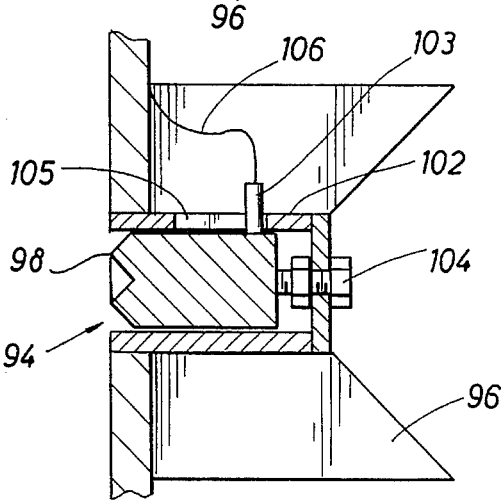
FIG. 8C is a cross sectional close up of the set screw assembly taken at line 8A—8A in FIG. 8B.

FIG. 8C is a close up of one of set screws 94. The engaging edge of the set screw is a point 98 of a block 100 slidingly received within track 102. Driving nut 104 causes block 100 to advance. A lead wire 106 passes through the housing of track 102 to cathodically connect block 100 to anodes 74 to cylindrical base 29. Lead wire 106 is welded to block 100 on one end and on the other end and these connections and the lead wire serve to pass cathodic current through cylindrical base 29 much more efficiently than would be possible through screw threads or swivelling connections. The point of set screw 94 biting into the surface of a pile will then efficiently provide this cathodic protection to the pile and possibly to the tendon receptacle therein. An alternate configuration for lead wire 106 is also illustrated in FIG. 8C. There track 102 is and a post 103 welded on one end to block 100 travels in slot 105. The lead wire is connected to block 100 by welding to the other end of post 103. Note also that similar cathodic protections and lead wire arrangements may be deployed with the slips illustrated in FIGS. 4A–4D.

FIGS. 9A and 9B disclose another embodiment of a tendon foundation guide cone assembly. There steel bars 75 holding anodes 74 provide structural support for the guide cones in much the same manner as do vanes 31 in FIG. 1.

Tendon foundation guide assembly 10 has generally been referenced as having guide "cones," but it is noted that these need not be classic frustoconical guides. A range of variation is intended to be included thereby.

Other modifications, changes and substitutions are also intended in the foregoing disclosure. Further, in some instances, some features of the present invention will be employed without a corresponding use of other features described in these preferred embodiments. Accordingly, it is appropriate that the appended claims be construed broadly and in a manner consistent with the spirit and scope of the invention herein.

What is claimed is:

1. A tendon foundation guide assembly for deployment upon the top of an installed pile for cathodically protecting the pile and a tendon receptacle inside the pile, the tendon foundation guide assembly comprising:

a cylindrical base;

a load shoulder projecting radially inward from the cylindrical base to accept and seat upon the top of the installed pile;

an anode system comprising a plurality of electrically interconnected anodes; and a connection device provided by the cylindrical base suitable to secure the tendon foundation guide assembly to the pile and provide a secure electrical connection between the anode system and the pile; and transfer mounts provided by the tendon foundation guide assembly suitable to releasably secure the tendon foundation guide to a lowering device.

2. A tendon foundation guide assembly in accordance with claim 1, further comprising:

a downwardly disposed bottom cone guide attached below the cylindrical base; and an upwardly disposed top cone guide connected to the top of the cylindrical base and presenting a guide surface suitable to guide the lower end of the tendon into reception within the tendon receptacle within the installed pile.

3. A tendon foundation guide assembly in accordance with claim 2, wherein the connection device further comprises:

a plurality of radially disposed self-actuating slips presented to project inwardly from the cylindrical base upon axial actuation to securely engage the top of the installed pile; and at least one lead wire electrically connecting one of the slips and the anode system;

whereby the slips biting into the pile provide an efficient passage for cathodic current to pass from the anodes to the pile.

4. A tendon foundation guide assembly in accordance with claim 2, wherein the connection device further comprises:

ROV operable set screws arranged radially about the cylindrical base and projectable inwardly to bite into the surface of the pile; and at least one lead wire electrically connecting one of the set screws and the anode system;

whereby the set screws biting into the pile provide an efficient passage for cathodic current to pass from the anodes to the pile.

5. A method of providing cathodic protection to a pile installed in the ocean floor in a deepwater application, comprising:

providing a plurality of anodes on a tendon foundation guide cone assembly and electrically connecting at least one of a plurality of slips with at least one of the anodes;

releasable securing the tendon foundation guide cone assembly to a lower end of a tendon through a plurality of shear pins extending between the tendon foundation guide cone assembly and the tendon;

lowering the tendon foundation guide cone assembly on the lower end of the tendon to the pile;

engaging the slips between a cylindrical base of the tendon foundation guide cone assembly and the top of the pile surrounded thereby to secure the tendon foundation guide cone assembly to the installed pile and provide a secure electrical connection between the anodes and the pile;

landing load shoulders within the tendon foundation guide cone assembly upon the top of the installed pile; and further lowering the tendon to vertically shear the shear pins connecting the tendon to the tendon foundation guide cone assembly.

6. A method of providing cathodic protection to an installed pile, comprising:

providing a plurality of anodes on a tendon foundation guide assembly;

attaching the tendon foundation guide assembly to a lowering unit;

lowering the tendon foundation guide assembly on the lowering unit to the pile;

attaching the tendon foundation guide assembly to the installed pile and electrically connecting at least one of the anodes to the pile; and releasing the tendon foundation guide assembly from the lowering unit.

7. A method for providing cathodic protection in accordance with claim 6 wherein attaching the tendon foundation guide assembly on the lowering unit comprises releasable securing the tendon foundation guide assembly to the lower end of a tendon.

8. A method for providing cathodic protection in accordance with claim 7 wherein releasably securing the tendon foundation guide assembly to the lower end of a tendon comprises mounting a plurality of shear pins between the tendon foundation guide assembly and the tendon.

9. A method for providing cathodic protection in accordance with claim 8 wherein releasing the tendon foundation guide assembly from the lowering unit comprises landing load shoulders within the tendon foundation guide assembly upon the top of the installed pile and further lowering the tendon to vertically shear the shear pins connecting the tendon to the tendon foundation guide assembly.

10. A method for providing cathodic protection in accordance with claim 9 wherein attaching the tendon foundation guide assembly to the installed pile comprises engaging a plurality of self-actuating vertically disposed slips between the tendon foundation guide assembly and the top of the pile surrounded thereby and wherein providing a plurality of anodes on a tendon foundation guide assembly further comprises electrically connecting at least one of the anodes to at least one of the slips.

11. A method for providing cathodic protection in accordance with claim 6 wherein attaching the tendon foundation guide assembly to the installed pile comprises driving a plurality of set screws extending through the tendon foundation guide assembly with an ROV to bite into the exterior of the pile and wherein providing a plurality of anodes on a tendon foundation guide assembly further comprises electrically connecting at least one of the anodes to at least one of the set screws.

12. A method for providing cathodic protection in accordance with claim 11 wherein attaching the tendon foundation guide on the lowering unit comprises attaching buoyancy tanks to the tendon foundation guide assembly and engaging an ROV and wherein lowering the tendon foundation guide assembly comprises swimming the ROV with the tendon foundation guide assembly engaged.

13. A method for providing cathodic protection in accordance with claim 6 wherein attaching the tendon foundation guide assembly on the lowering unit comprises:

attaching a first end of a multipoint sling to the tendon foundation guide assembly and attaching a second end to a terminal end of a crane cable.

14. A method for providing cathodic protection in accordance with claim 13 wherein releasing the tendon foundation guide assembly from the lowering unit comprises cutting the first end of the multipoint sling at a plurality of cable loops slung through the tendon foundation guide assembly.

15. A method for providing cathodic protection in accordance with claim 13 wherein attaching the tendon foundation guide assembly to the installed pile comprises engaging a plurality of self-actuating vertically disposed slips between the tendon foundation guide assembly and the top of the pile surrounded thereby and wherein providing a plurality of anodes on a tendon foundation guide assembly further comprises electrically connecting at least one of the anodes to at least one of the slips.

16. A method for providing cathodic protection in accordance with claim 13 wherein attaching the tendon foundation guide assembly to the installed pile comprises driving a plurality of set screws extending through the tendon foundation guide assembly with an ROV to bite into the exterior of the pile and wherein providing a plurality of anodes on a tendon foundation guide assembly further comprises electrically connecting at least one of the anodes to at least one of the set screws.

17. A method for providing cathodic protection in accordance with claim 6 wherein attaching the tendon foundation guide on the lowering unit comprises attaching a heave compensated buoy to the tendon foundation guide assembly.

18. A method for providing cathodic protection in accordance with claim 6 wherein attaching the tendon foundation guide on the lowering unit comprises attaching the tendon foundation guide assembly on a drill string and lowering the tendon foundation guide assembly comprises running the drill string.

* * * * *